US006488986B2

(12) United States Patent
Das et al.

(10) Patent No.: US 6,488,986 B2
(45) Date of Patent: Dec. 3, 2002

(54) COMBINED COAT, HEAT TREAT, QUENCH METHOD FOR GAS TURBINE ENGINE COMPONENTS

(75) Inventors: Nripendra N. Das, West Chester, OH (US); Terri K. Brown, Central City, KY (US); Matthew D. Saylor, Blanchester, OH (US); Brian H. Pilsner, Mason, OH (US); Carl H. Snyder, Madisonville, KY (US)

(73) Assignee: General Electric Company, Schenectady, NY (US)

( * ) Notice: Subject to any disclaimer, the term of this patent is extended or adjusted under 35 U.S.C. 154(b) by 173 days.

(21) Appl. No.: 09/771,897

(22) Filed: Jan. 29, 2001

(65) Prior Publication Data

US 2002/0102357 A1 Aug. 1, 2002

(51) Int. Cl.[7] ..... C23C 16/06

(52) U.S. Cl. ..... 427/250; 427/374.3; 427/374.6; 427/376.6

(58) Field of Search ..... 427/250, 374.1, 427/374.3, 374.6, 376.6, 376.8

(56) References Cited

U.S. PATENT DOCUMENTS

| | | | | | |
|---|---|---|---|---|---|
| 4,450,056 | A | * | 5/1984 | Gray | 204/98 |
| 5,240,518 | A | * | 8/1993 | Wortman et al. | 148/404 |
| 5,910,219 | A | | 6/1999 | Perry et al. | |
| 5,925,198 | A | * | 7/1999 | Das | 148/410 |
| 6,039,810 | A | | 3/2000 | Mantkowski et al. | |
| 6,146,696 | A | | 11/2000 | Das et al. | |
| 6,383,448 | B1 | * | 5/2002 | Das | 420/445 |

* cited by examiner

*Primary Examiner*—Bret Chen
(74) *Attorney, Agent, or Firm*—David L. Narciso; Sonnenschein, Nath & Rosenthal

(57) ABSTRACT

A method for imparting an aluminide coating to an alloy gas turbine engine component, heat treating the component, and quenching the component. The component is exposed to a source of aluminum at an elevated temperature in a coating furnace to deposit an aluminum-based oxidation barrier on the component, heated in the coating furnace to a temperature of at least the solution temperature of the alloy, and quenched by flowing a chilled inert gas around the component in the coating furnace to cool the component from the temperature of at least the solution temperature of the alloy to a temperature at which a gamma' phase of the alloy is set in the alloy in less than about 10 minutes.

18 Claims, 3 Drawing Sheets

COMBINED COAT, HEAT TREAT, QUENCH METHOD FOR GAS TURBINE ENGINE COMPONENTS

BACKGROUND OF THE INVENTION

This invention relates to a method for coating components of gas turbine engines, such as by aluminide coating, heat treating the components, and rapidly quenching the components in a combined operation using a single apparatus.

To provide protection against high temperature oxidation and hot corrosion, components of gas turbine engines such as turbine airfoils are subjected to, for example, diffusion aluminide coating. Diffusion coatings are imparted by a thermal/chemical reaction process typically requiring a reducing or inert atmosphere at an elevated temperature. A diffusion aluminide coating, for example, may be imparted at roughly 1975° F. (1080° C.).

Engine components are often strengthened after diffusion coating by being subjected to aging. In order to optimize these aging effects, it is necessary to first set the g' (gamma prime) phase by quenching the components rapidly to below the age temperature after holding the component steady for, for example, 4 hours, at the alloy solution temperature. Heretofore, it has only been possible to achieve the quench rate necessary to set the g' phase by using a vacuum furnace. Such furnaces have not been employed for coating operations because the byproducts from such operations damage the furnace's ability to maintain desired vacuum level. Furnaces suitable for coating operations have not been able to achieve the rapid quench rate required to set the g' phase. Diffusion coating furnaces have not been capable of quenching the components to below the age temperature sufficiently rapidly. As such, aluminide coated components have been coated in a diffusion coating furnace, allowed to cool, removed from the diffusion coating furnace, placed in a heat treatment furnace, heated to the solution temperature, held at that temperature for the required time period, then rapidly quenched.

SUMMARY OF THE INVENTION

Briefly, therefore, the invention is directed to a method for imparting an aluminide coating to an alloy gas turbine engine component, heat treating the component, and quenching the component by exposing the component to a source of aluminum at an elevated temperature in a coating furnace to deposit an aluminum-based oxidation barrier on the component, heating the component in the coating furnace to a temperature of at least the solution temperature of the alloy, and quenching the component by flowing an inert gas around the component in the coating furnace to cool the component from the temperature of at least the solution temperature of the alloy to a temperature at which a gamma' phase of the alloy is set in the alloy in less than about 10 minutes.

In another aspect, the invention is directed to a method for imparting an aluminide coating to alloy gas turbine engine components, heat treating the components, and quenching the components, all in a coating vessel of a coating furnace such that the ratio of the mass of the components to the volume of the coating vessel is less than about 12 lbs/cubic foot (200 kg/cubic meter).

The invention is further directed to a method for imparting an aluminide coating to a plurality of Ni-based alloy gas turbine engine components, heat treating the components, and quenching the components in which the components are arranged irregularly with respect to each other in a coating can in a coating furnace to reduce reflection of heat between said components, thereby facilitating rapid quenching.

DETAILED DESCRIPTION OF THE INVENTION

This invention is drawn to a process for use in imparting an aluminide coating to an airfoil or other component, heat treating the component at the solution temperature, and rapidly quenching the component to below the age temperature to set the g' phase. The gas turbine engine components coated and quenched in accordance with this invention are typically turbine airfoils, including nozzles and blades, manufactured from a variety of alloys including Rene' N4, Rene' N5, Rene' 80, Rene' 142, and DRS 108, for example. "Rene'" is a registered trademark owned by Teledyne Industries, Inc. of Los Angeles, Calif., USA.

Figure 1:
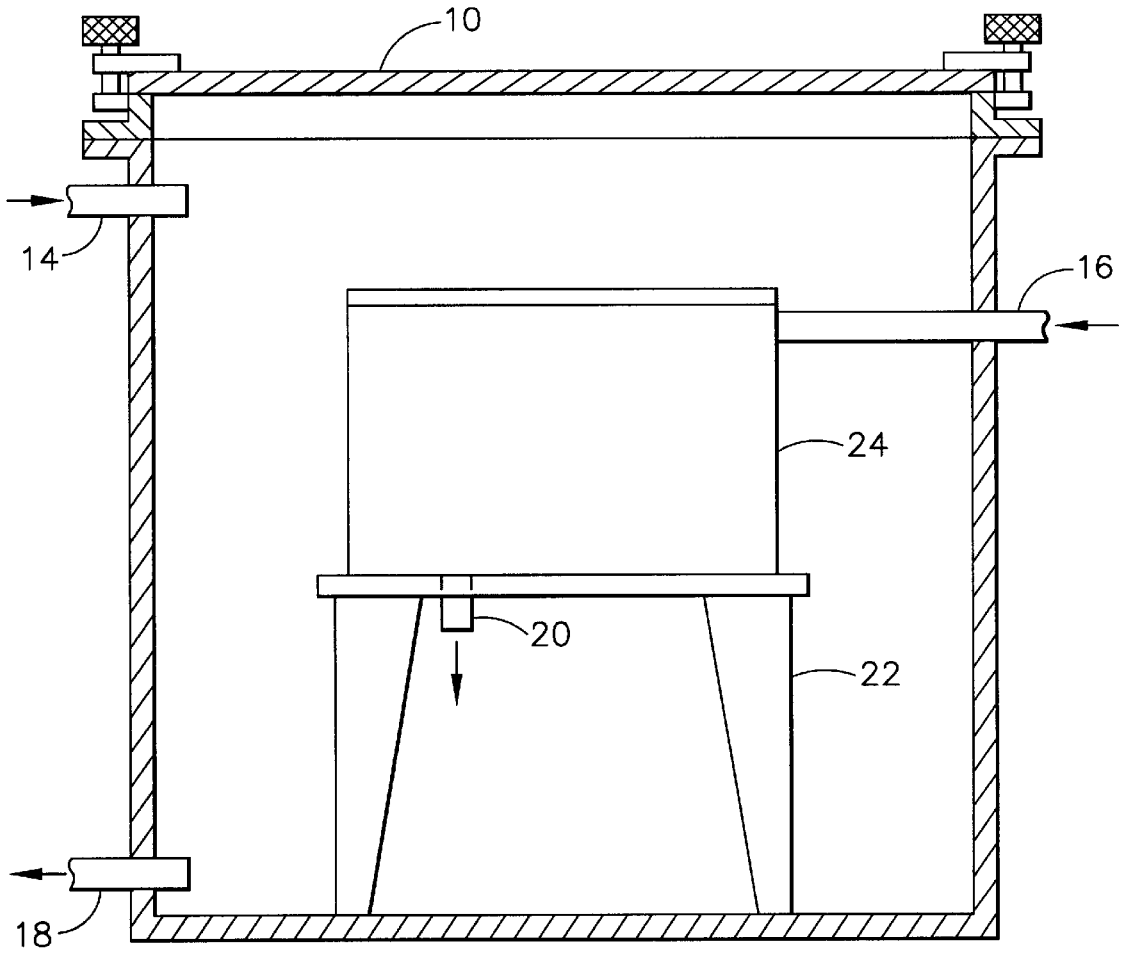
FIG. 1 is a schematic illustration of the coating and quenching apparatus of the invention.
Figure 2:
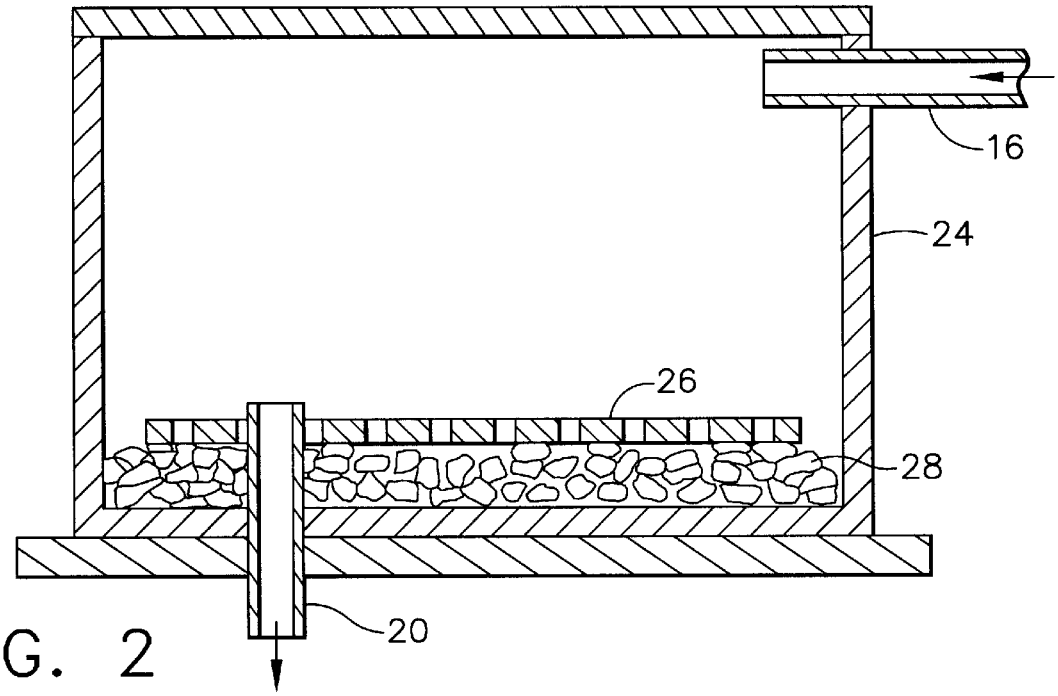
FIG. 2 is a schematic illustration of the coating can of the coating and quenching apparatus of the invention.

With reference to FIG. 1, the apparatus is depicted generally in schematic form and includes a furnace shell 10, a furnace shell argon inlet 14, a can argon inlet 16, a furnace shell exhaust 18, a can exhaust 20, a workload support 22, and a can 24. The can 24 of the apparatus is further depicted schematically in FIG. 2 and includes support platform 26. Donor alloy pellets 28 are depicted in the can, and an activator compound such as aluminum fluoride as is known in the art is also present. The furnace is top-loading, about 30 inches (75 cm) in diameter and about 30 inches (75 cm) deep. The can is about 12 inches (30 cm) to 15 inches (38 cm) in diameter and about 10 inches (25 cm) to about 12 inches 30 cm) tall. There is a support tree 30 shown in FIGS. 3 and 4 for supporting airfoils 32.

In accordance with this invention, a diffusion coating is applied to one or more gas turbine engine components at an elevated temperature. In one particularly preferred embodiment, the components are situated within the can of the above-described apparatus and the can and the furnace chamber are purged with argon. The purge to the can is discontinued and the components are subjected to vapor phase aluminide (VPA) coating by heating the apparatus to a temperature in the range of at least about 1950° F. (1065° C.), preferably from about 1950° F. (1065° C.) to about 2000° F. (1095° C.). Aluminum from the donor alloy pellets is vaporized. The apparatus is then maintained at that temperature for about 3 to about 8 hours, most preferably for about 4 hours, to accomplish coating. A slow purge is maintained on the furnace chamber during the coating process. After coating, the can and the furnace chamber are both purged with argon at a flow rate of about 50 $ft^3$/hr (1.5 $m^3$/hr).

The components are then optionally subjected to further heat treatment by maintaining them at the heat treat temperature for additional time. After coating or after this optional further heat treatment, the components are subjected to rapid quenching. This is accomplished by discontinuing the application of heat to the furnace, and flowing argon which has been chilled to a temperature below at least about −60° C., preferably to between about −60° C. and about −100° C., into the furnace and into the can. The flow rate of inert gas into the can and into the furnace is preferably at least about 40 volume changes/hr. The flow rate of argon into the can and around the can in one particularly preferred embodiment is in the range of about 40 volume changes/hr to about 50 volume changes/hr during quenching. Depending on the size of the furnace and the mass in the furnace The components are thereby quenched from roughly 1975° F. (1080° C.) to 1200° F. (650° C.) within six minutes. The flow of argon is continued until the components reach roughly 200° F. (95° C.), at which time the furnace automatically opens. The flow of argon is discontinued, and the components are cool enough to handle in about 20 minutes.

In the past it has only been possible to achieve the quench rate necessary to set the g' phase by using a vacuum furnace such as is available from Ipson Abar of Rockford, Ill., USA. Such furnaces are especially expensive, and not suited to coating operations. Furnaces suitable for coating operations have not been able to achieve the rapid quench rate required to set the g' phase. One significant aspect of the method of the invention is the ratio of the mass of the components being coated/quenched to the volume of the coating vessel, which in this embodiment is the coating can. It is thought that previous arrangements had a ratio of component mass to furnace volume which was too high. In the preferred embodiment of the invention, therefore, the ratio of component mass to furnace volume is maintained below about 12 lbs/cubic foot (200 kg/cubic meter), preferably below about 10 lbs/cubic foot (160 kg/cubic meter), and most preferably between about 6 and about 10 lbs/cubic foot (between about 90 and about 160 kg/cubic meter) .

These obstacles to rapid quench with a coating apparatus have been overcome by this invention in part by selection of the particular parameters and features described above. Without being bound to a particular theory, it is thought that another factor in achieving the required quench rate is the specific arrangement and specific components for the coating can. In particular, it is thought that in arrangements such as that disclosed in U.S. Pat. No. 5,910,219 FIG. 2, where the donor alloy pellets are in close proximity to the component being coated, the portion of the donor pellets which are not consumed during coating have a disadvantageous effect of reflecting heat back onto the components during quenching, thus slowing the quench rate. In this invention, therefore, the donor alloy pellets are placed in the bottom of the can, remote from the surfaces of the components being coated, or at least sufficiently remote to avoid this type of reflection.

It is also thought that in arrangements such as FIG. 1 in U.S. Pat. No. 5,910,219 and other previous arrangements, the placement of airfoils or other components in regular, ordered arrangement with each component being similarly oriented in the furnace results in heat being reflected between the mating surfaces of the adjacent components, thus slowing the quench rate. With the present invention, therefore, convex surfaces are not positioned so as to reflect heat to concave surfaces, for example, and similar arrangements which similarly involve generally parallel surfaces on components facing each other, are avoided. The adjacent components are therefore positioned irregularly with respect to each other, to reduce the amount of heat reflection therebetween, and to increase the rate of heat dissipation. In one preferred embodiment, each component is rotated at least about 30° in some direction, for example, around a vertical axis, with respect to its with respect its adjacent component or components.

Figure 4:
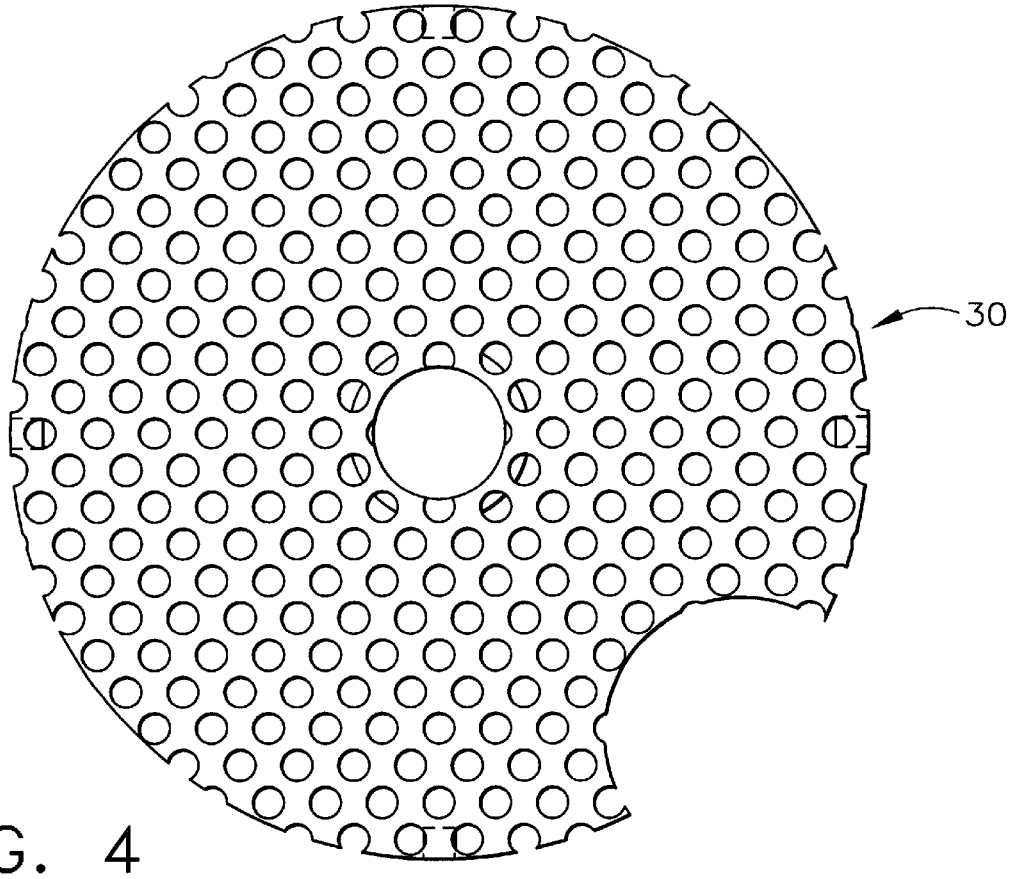
FIG. 4 is a schematic top view of the coating tree support of the invention.
Figure 3:
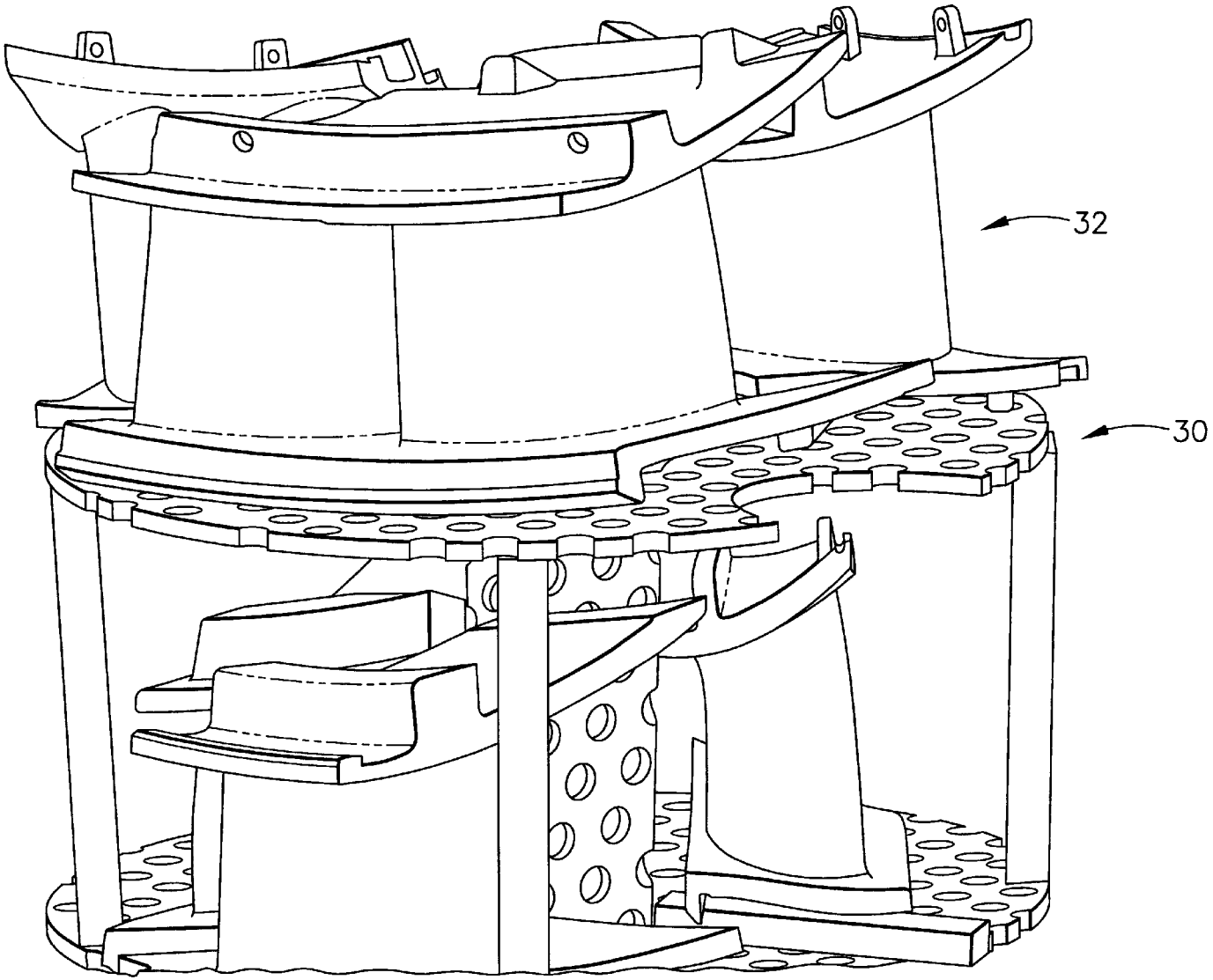
FIG. 3 is a schematic side view of the coating tree support of the invention.

To achieve an arrangement of components in accordance with the invention, a support tree 30 for supporting the components to be coated is provided as depicted in FIGS. 3 and 4. This tree is preferably constructed from Inconel 600. "Inconel" is a registered trademark owned by Inco Alloys International, Inc. of Huntington, W. Va., USA. There irregular arrangement of the adjacent components is illustrated in FIG. 3.

The can used in the apparatus of the invention is manufactured from a material which has a heat conductivity of at least about 80 W/m-deg K, preferably in the range of about 80 W/m-deg K to about 95 W/m-deg K. In the preferred embodiment, the can is manufactured from isostatically molded ultra high purity (less than 20 ppm ash content) graphite. This particular graphite has a heat conductivity on the order of about 85 W/m-deg K. In contrast, less pure graphite can have a heat conductivity of, for example, 40 W/m-deg K, likely due to impurities in the graphite and their interference with heat transfer.

EXAMPLE

High pressure turbine nozzles made from mono N5 alloy were arranged on the support tree depicted in FIG. 3 and placed inside the can depicted in FIG. 3, which was placed inside the furnace depicted in FIG. 1. The can was purged with argon. The components were subjected to aluminide coating for 4 hours at a temperature of 1975° F. (1080° C.) in the apparatus depicted in FIGS. 1 and 2. The source of aluminum was chromium-aluminum pellets placed in the bottom of the can. Argon at a temperature of about −60° C. was flowed at a rate of about 60 $ft^3$/hr (1.7 $m^3$/hr) into the furnace chamber during coating.

Heat was discontinued to the furnace, and the components were quenched by flowing argon at a temperature of about −60° C. and a flow rate of about 50 volume changes/hr into the can, while flowing argon at a temperature of about −60° C. and a flow rate of about 50 $ft^3$/hr (1.5 $m^3$/hr) into the furnace chamber. This was continued for about 6 minutes, at which time the components reached a temperature of about 1200° F. (650° C.). These conditions were continued for about 20 minutes, at which time the furnace opened with the components having reached a temperature of about 250° F. (120° C.).

As various changes could be made in the above embodiments without departing from the scope of the invention, it is intended that all matter contained in the above description shall be interpreted as illustrative and not in a limiting sense.

What is claimed is:

1. A method for imparting an aluminide coating to an alloy gas turbine engine component, heat treating the component, and quenching the component comprising:

coating the component by exposing the component to a source of aluminum at an elevated temperature in a coating furnace to deposit an aluminum-based oxidation barrier on the component;

heating the component in said coating furnace to a temperature of at least the solution temperature of the alloy;

quenching the component by flowing an inert gas around the component in said coating furnace to cool the component from the temperature of at least the solution temperature of the alloy to a temperature at which a gamma' phase of the alloy is set in the alloy in less than about 10 minutes.

2. The method of claim 1 wherein said inert gas is chilled.

3. The method of claim 2 wherein said inert gas is chilled to a temperature below about −60° C.

4. The method of claim 1 comprising:

coating and heat treating the component by heating the component in said coating furnace to said first temperature, wherein said first temperature is at least about 1950° F., in the presence of said source of vapor phase aluminum;

maintaining the component at said first temperature for a period of at least about three hours to deposit said aluminum-based oxidation barrier on the component;

cooling the component to said second temperature at which said gamma' phase of the alloy is set by flowing chilled argon around the component until the component reaches said second temperature, wherein said second temperature is less than about 1200° F.

5. The method of claim 4 wherein said cooling comprises flowing argon chilled to a temperature below about −60° C. around the component at a flow rate of at least about 40 volume changes/hr such that the component reaches said second temperature in from about 5 minutes to about 10 minutes.

6. The method of claim 5 wherein said component is coated, heat treated, and quenched in conjunction with a plurality of similarly shaped components and said components are arranged in said furnace with adjacent components oriented irregularly with respect to each other to reduce reflection of heat therebetween.

7. The method of claim 6 wherein adjacent components are rotated with respect to each other at least about 30°.

8. The method of claim 7 wherein adjacent components are rotated with respect to each other at least about 30° around a vertical axis.

9. A method for imparting an aluminide coating to alloy gas turbine engine components, heat treating the components, and quenching the components comprising:

placing components in a coating vessel of a coating furnace wherein the coating vessel has a volume and the engine components have a mass such that the mass of the components has a ratio to the volume of the coating vessel which is less than about 12 lbs/cubic foot;

coating the components by exposing the components to a source of aluminum at an elevated temperature in said coating vessel to deposit an aluminum-based oxidation barrier on the component;

heating the components in said coating furnace to a temperature of at least the solution temperature of the alloy;

quenching the components by flowing an inert gas around the components in said coating furnace to cool the components from the temperature of at least the solution temperature of the alloy to a temperature at which a gamma' phase of the alloy is set in the alloy in less than about 10 minutes.

10. The method of claim 9 wherein the ratio of the mass of the components to the volume of the coating vessel is less than about 10 lbs/cubic foot.

11. The method of claim 10 wherein the ratio of the mass of the components to the volume of the coating vessel is between about 6 lbs/cubic foot and about 10 lbs/cubic foot.

12. A method for imparting an aluminide coating to a plurality of Ni-based alloy gas turbine engine components, heat treating the components, and quenching the components comprising:

arranging the components irregularly with respect to each other in a coating can in a coating furnace to reduce reflection of heat between said components;

coating and heat treating the components simultaneously by heating the components in said coating furnace to a first temperature of at least the solution temperature of the Ni-based alloy in the presence of source of vapor phase aluminum;

maintaining the components at said first temperature to deposit an aluminum-based oxidation barrier on the components;

cooling the components to a second temperature at which a gamma' phase of the alloy is set by flowing inert gas around the components in said coating furnace until the components reach said second temperature.

13. The method of claim 12 wherein adjacent components are rotated with respect to each other at least about 30°.

14. The method of claim 13 wherein adjacent components are rotated with respect to each other at least about 30° around a vertical axis.

15. The method of claim 12 wherein said first temperature is at least about 1950° F. and wherein said cooling comprises flowing chilled argon into said can at a rate of at least about 40 volume changes/hr while flowing argon around said can at a rate of at least about 40 volume changes/hr until the components reach said second temperature, wherein said second temperature is less than about 1200° F.

16. The method of claim 15 wherein said argon flow into said can is at a flow rate of from about 40 volume changes/hr to about 50 volume change/hr and wherein said argon flow around said can is at a flow rate of from about 40 volume changes/hr to about 50 volume changes/hr.

17. The method of claim 12 wherein said components are cooled to said second temperature in about 6 minutes.

18. The method of claim 12 wherein said coating, heat treating, and cooling are carried out in a coating vessel wherein the coating vessel has a volume and the engine components have a mass such that the mass of the components has a ratio to the volume of the coating vessel which is less than about 10 lbs/cubic foot.

* * * * *